US008191353B2

(12) United States Patent
Kakinohana et al.

(10) Patent No.: US 8,191,353 B2
(45) Date of Patent: Jun. 5, 2012

(54) DEVICE AND METHOD FOR CONTROLLING INTERNAL COMBUSTION ENGINE

(75) Inventors: Masaru Kakinohana, Susono (JP); Hirohito Hirata, Shizuoka (JP); Masaya Ibe, Susono (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 822 days.

(21) Appl. No.: 12/302,519

(22) PCT Filed: Jul. 4, 2007

(86) PCT No.: PCT/JP2007/063769
§ 371 (c)(1),
(2), (4) Date: Nov. 26, 2008

(87) PCT Pub. No.: WO2008/004704
PCT Pub. Date: Jan. 10, 2008

(65) Prior Publication Data

US 2009/0235648 A1 Sep. 24, 2009

(30) Foreign Application Priority Data

Jul. 5, 2006 (JP) ..... 2006-185963

(51) Int. Cl.
*F01N 3/00* (2006.01)
*F01N 3/02* (2006.01)

(52) U.S. Cl. ..... 60/275; 60/274; 60/285; 60/286; 60/295; 60/297; 60/311

(58) Field of Classification Search ..... 60/274, 60/275, 282, 285, 286, 295, 297, 304, 311
See application file for complete search history.

(56) References Cited

U.S. PATENT DOCUMENTS

| | | | | |
|---|---|---|---|---|
| 2004/0045279 | A1* | 3/2004 | Pfendtner et al. | 60/275 |
| 2005/0241295 | A1* | 11/2005 | Breuer et al. | 60/274 |
| 2009/0308060 | A1* | 12/2009 | Suzuki et al. | 60/311 |

FOREIGN PATENT DOCUMENTS

| | | |
|---|---|---|
| DE | 102 31 620 | 1/2004 |
| FR | 2 877 588 | 5/2006 |
| JP | 2-308917 | 12/1990 |
| JP | 06-008720 | 2/1994 |

(Continued)

OTHER PUBLICATIONS

Sakakibara et al., English Abstract of JP 2006-307802 A, Nov. 9, 2006.*

(Continued)

*Primary Examiner* — Thomas Denion
*Assistant Examiner* — Audrey K Bradley
(74) *Attorney, Agent, or Firm* — Finnegan, Henderson, Farabow, Garrett & Dunner, LLP

(57) ABSTRACT

A device for controlling an internal combustion engine comprises a device for trapping particulate matter (PM) in exhaust gas in an exhaust passage, means for supplying ozone to the particulate matter trapping device from the upstream thereof to oxidize and remove PM deposited in the device, and means for interrupting the fuel injection of the internal combustion engine upon the execution of ozone supply by the ozone supply means. It is possible to prevent components consuming ozone, such as NOx, from being contained in the exhaust gas of the internal combustion engine, whereby ozone is effectively usable.

8 Claims, 4 Drawing Sheets

FOREIGN PATENT DOCUMENTS

| | | | |
|---|---|---|---|
| JP | 6-272541 | | 9/1994 |
| JP | 8-266868 | | 10/1996 |
| JP | 9-125931 | | 5/1997 |
| JP | 2001-317336 | | 11/2001 |
| JP | 2002-531762 | | 9/2002 |
| JP | 2005-502823 | | 1/2005 |
| JP | 2005-504207 | | 2/2005 |
| JP | 2006-307802 | | 11/2006 |
| JP | 2006307802 A | * | 11/2006 |
| WO | WO 00/34632 | | 6/2000 |
| WO | WO 03/026778 | | 4/2003 |
| WO | WO 03/027452 | | 4/2003 |

OTHER PUBLICATIONS

Extended European Search Report for EP Appl. No. 07768385.2 dated Oct. 19, 2010.

Decision to Grant a Patent for JP 2006-185963 mailed Jan. 5, 2010.

* cited by examiner

IN CASE OF T1<T0<T2

IN CASE OF T1<T2<T0

DEVICE AND METHOD FOR CONTROLLING INTERNAL COMBUSTION ENGINE

CROSS-REFERENCE TO RELATED APPLICATIONS

This application is a national phase application of International Application No. PCT/JP2007/063769, filed Jul. 4, 2007, and claims the priority of Japanese Application No. 2006-185963, filed Jul. 5, 2006, the contents of both of which are incorporated herein by reference.

FIELD OF TECHNOLOGY

The present invention relates to a device and a method for controlling an internal combustion engine, particularly to those in which the engine comprises an exhaust gas cleaning apparatus for cleaning particulate matter in exhaust gas discharged from a diesel engine by trapping and oxidizing the particulate matter.

BACKGROUND ART

It has been known in general that the exhaust gas discharged from the diesel engine contains particulate matter (hereinafter referred to PM) mainly composed of carbon, causing the atmospheric contamination. Accordingly, various devices and methods have been proposed, for trapping the particulate matter and removing it from the exhaust gas.

For example, there have been many proposals wherein the temperature of a diesel particulate filter (DPF) is elevated by forcibly supplying fuel by the injection so that the trapped PM is oxidized and burnt, or NO2 is generated from NO in the exhaust gas and used for oxidizing PM (see Japanese Patent Laid-Open No. 2002-531762, for example), or a catalyzed DPF is used for oxidizing PM (see, for example, Japanese Patent Laid-Open No. H6-272541 and No. H9-125931). There is a problem in the proposals wherein the fuel is forcibly supplied by the injection in that the fuel consumption becomes worse. While, the proposal described in Japanese Patent Laid-Open No. 2002-537162 has a problem in that it is difficult to completely oxidizing PM discharged from the engine and removing the same since the oxidation speed of PM by NO2 is insufficient. In those using the catalyzed DPF described in Japanese Patent Laid-Open No. H6-272541 and No. H9-125931, there is a problem in that, since the catalyst and PM are a solid substance, the both are not sufficiently in contact with each other and result in the incomplete oxidation reaction.

To solve such problems, there has been disclosed (for example, in Japanese Patent Laid-Open No. 2005-502823) a technique for processing PM by the oxidation while using ozone O3 having an oxidization power higher than that of NO2. According to the method and the device for post-processing exhaust gas of the diesel engine disclosed in Japanese Patent Laid-Open No. 2005-502823, a device for generating ozone O3 or nitrogen dioxide NO2 as oxidizing agent from exhaust gas by using plasma is provided upstream from a particulate filter, wherein soot trapped in the particulate filter is oxidized and removed by selectively using ozone and nitrogen dioxide in accordance with the temperature of the exhaust gas, so that when the exhaust gas is at a high temperature, both of ozone and nitrogen dioxide are used, while at a low temperature, nitrogen dioxide is solely used.

In this regard, in the method and the device for post-processing exhaust gas from the diesel engine described in Japanese Patent Laid-Open No. 2005-502823, the improvement in the power for oxidation and removal of PM is recognizable because of the use of ozone O3 higher in oxidation power than NO2. However, there is a risk in that ozone having a high oxidation power may be consumed by the preferential reaction with NOx or HC in the exhaust gas prior to being introduced into the particulate filter, resulting in a problem that an amount of ozone usable for the oxidation and removal of PM becomes less to lower the cleaning efficiency and the oxidation speed of PM.

DISCLOSURE OF THE INVENTION

An object of the present invention is to provide a device and a method for controlling an internal combustion engine capable of effectively using ozone when PM is oxidized and removed.

To achieve the above-mentioned object, a device for controlling an internal combustion engine according to one aspect of the present invention comprises a device for trapping particulate matter in exhaust gas in an exhaust passage; means for supplying ozone to said particulate matter trapping device from the upstream thereof; and means for interrupting the fuel injection of said internal combustion engine upon the execution of ozone supply by said ozone supply means.

According to this aspect, since the fuel injection of the internal combustion engine is interrupted during the execution of the ozone supply, it is possible to prevent the ozone-consuming components such as NOx or HC from being contained in exhaust gas (substantially air), whereby the supplied ozone is effectively usable for the oxidation of PM in the particulate matter trapping device.

Here, preferably, the control device further comprises means for forecasting whether or not a temperature of said particulate matter trapping device abnormally rises when the fuel injection is interrupted by said fuel injection interrupting means, wherein said fuel injection interrupting means executes the interruption of the fuel injection when the abnormal temperature rise of said particulate matter trapping device is not forecast by said forecasting means.

When the fuel injection is interrupted, a relatively large amount of air flows into the particulate matter trapping device, and PM deposited in the particulate matter trapping device instantly burns by the influence of this air, whereby the temperature of the particulate matter trapping device abnormally rises to result in the inconvenience such as melting or crack thereof. According to this preferable aspect, since the interruption of fuel injection is executed when said forecasting means forecasts that the temperature of the particulate matter trapping device does not abnormally rises, it is possible to assuredly avoid the inconvenience such as the welding or crack of the particulate matter trapping device.

Also, the control device preferably further comprises means for detecting a bed temperature of said particulate matter trapping device or a temperature of exhaust gas flowing into said particulate matter trapping device, wherein the supply of ozone is not executed until a temperature detected by said temperature detecting means becomes lower than a first predetermined value after the interruption of the fuel injection by said fuel injection interrupting means, and the supply of ozone is executed after the detected temperature becomes lower than the first predetermined value.

Ozone has a proper temperature window for the oxidation of PM, and ozone is thermally decomposed and disappears at a temperature higher than the temperature window. According to this preferable aspect, the supply of ozone is not executed until the temperature detected by the temperature detecting means becomes lower than the first predetermined value after the fuel injection has been interrupted by the fuel injection interrupting means, and ozone is supplied after the detected temperature becomes lower than the first predetermined value. Accordingly, it is possible to avoid the useless consumption of ozone until the detected temperature is lower than the first predetermined value, and after the detected temperature is lower than the first predetermined value, it is possible to use ozone for oxidizing PM while avoiding the disappearance of ozone, resulting in the effective application of ozone.

Preferably, when it is forecasted by said forecasting means that the temperature of said particulate matter trapping device abnormally rises, said fuel injection interrupting means does not execute the interruption of fuel injection, but the supply of ozone or a predetermined forcible regeneration control is executed.

When the abnormal temperature rise is forecast by the forecasting means, the fuel injection interrupting means does not execute the interruption of fuel injection, whereby, if ozone is supplied, at least part thereof is consumed by the reaction with the ozone-consuming components such as NOx or HC in the exhaust gas. However, if the supply of ozone is executed even in such a circumstance, NO in the exhaust gas reacts with ozone to generate nitrogen dioxide NO2 having a relatively strong oxidative power, whereby the deposited PM is oxidized and removed by this ozone and nitrogen dioxide. Also, the deposited PM may be oxidized by the predetermined forcible regeneration control.

In this regard, the forecasting means may compare the temperature detected by said temperature detecting means with a second predetermined value to determine whether or not the abnormal temperature rise occurs in said particulate matter trapping device.

A method for control an internal combustion engine according to another aspect of the present invention comprises the steps of supplying ozone to a device for trapping particulate matter in an exhaust passage from the upstream of the device, and interrupting the fuel injection of said internal combustion engine during the execution of the ozone supply.

Here, the method preferably further comprises a step of forecasting whether or not the temperature of said particulate matter trapping device abnormally rises when said fuel injection is interrupted, wherein if it is forecast by said forecasting step that the temperature of said particulate matter trapping device does not abnormally rise, said step for interrupting the fuel injection is executed.

Also, preferably, the method further comprises a step of detecting a temperature of exhaust gas flowing into said particulate matter trapping device or a bed temperature of said particulate matter trapping device, wherein said ozone supplying step is not executed until the temperature detected by said temperature detecting step becomes lower than the first predetermined value after interrupting the fuel injection in the interrupting step, but is executed after the detected temperature has become lower than the first predetermined value.

Also, preferably, if it is forecast by said forecasting step that the temperature of said particulate matter trapping device abnormally rises, said fuel injection interrupting step is not executed but said ozone supply or a predetermined forcible regeneration control is executed.

At said forecasting step, the temperature detected at said temperature detecting step is preferably compared with a second predetermined value to determine whether or not the abnormal temperature rise occurs in said particulate matter trapping device.

According to the present invention, an excellent effect is obtainable for effectively using ozone when PM is oxidized and removed by using ozone.

BEST MODE FOR CARRYING OUT THE INVENTION

Embodiments of the present invention will be described below with reference to the attached drawings.

Figure 1:
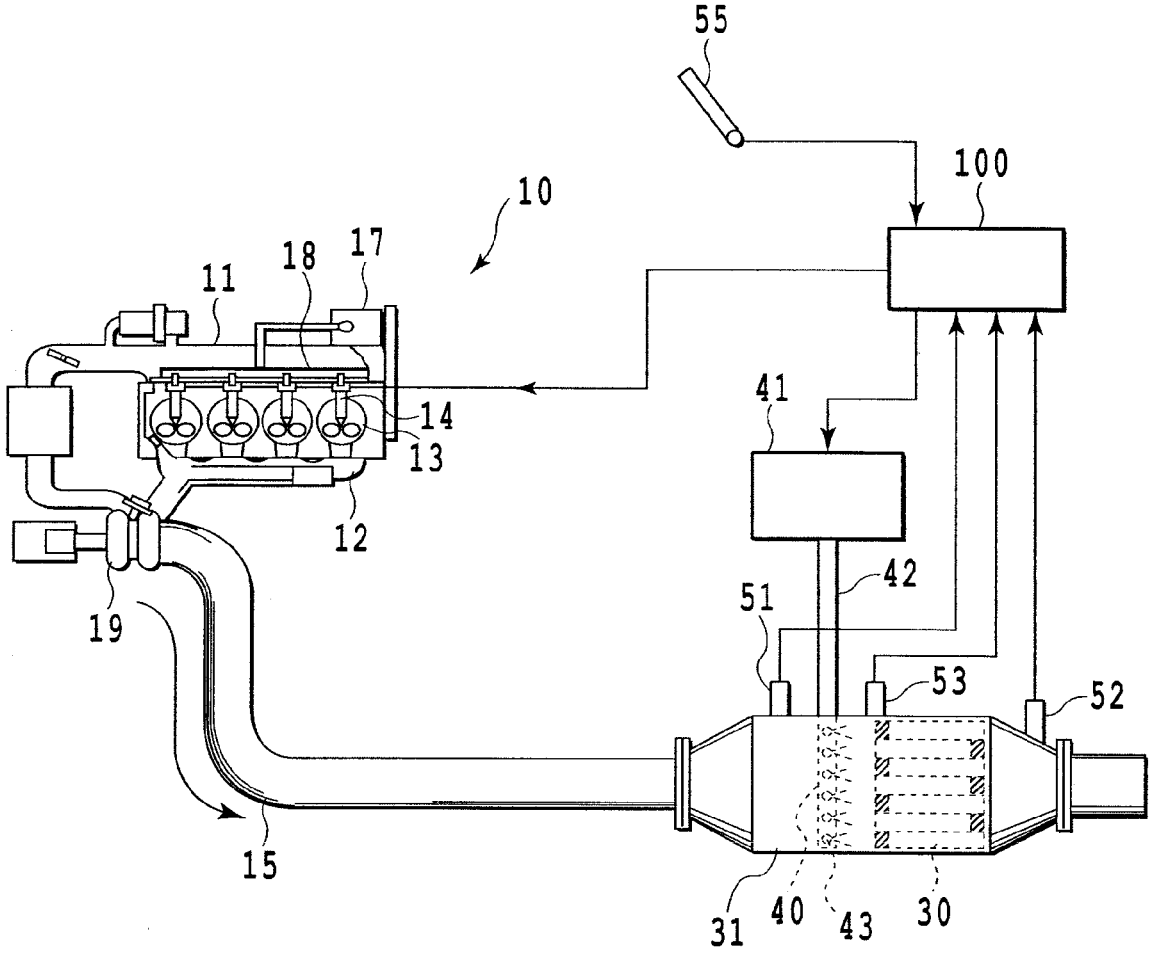
FIG. 1 is a system diagram illustrating a device for controlling an internal combustion engine according to an embodiment of the present invention.

FIG. 1 is a system diagram diagrammatically illustrating a device for controlling an internal combustion engine according to an embodiment of the present invention. In the drawing, reference numeral 10 denotes an internal combustion engine of a compressive ignition type; that is, a diesel engine in a case of this embodiment. Reference numeral 11 denotes an air-intake manifold communicated with an air-intake port, 12 denotes an exhaust manifold communicated with an exhaust port, and 13 denotes a combustion chamber. In this embodiment, fuel supplied from a fuel tank not shown to a high-pressure pump 17 is pumped to a common rail 18 and accumulated there at a high pressure, which fuel in the common rail 16 is then injected into the combustion chamber 13 directly from a fuel injection valve 14. Exhaust gas from the diesel engine 10 enters the exhaust manifold 12 and then a turbo charger 19. Thereafter, it flows into an exhaust passage 15 provided downstream from the turbo charger 19, and is discharged to the atmosphere after being cleaned as described later. In this regard, the diesel engine should not be limited to such a kind as having a fuel injection device of a common rail type. Also, it may include other exhaust cleaning devices, for example, an EGR device.

In the exhaust passage 15, a diesel particulate filter (hereinafter referred to as DPF) 30 is disposed as a device for trapping the particulate matter (PM). There is disposed means for supplying ozone (O3) to DPF 30 from the upstream thereof. As illustrated, the ozone supplying means is provided with an ozone supplying nozzle 40 located within the exhaust passage 15 upstream from DPF 30, and an ozone generator 41 as means for generating ozone connected to the ozone supplying nozzle 40 via an ozone supplying passage 42. Ozone generated in the ozone generator 41 is supplied to the ozone supplying nozzle 40 via the ozone supplying passage 42 and is injected into the exhaust passage 15 toward the downstream DPF 30 from the ozone supplying nozzle 40.

DPF 30 is housed in the interior of a metallic casing 31 of a generally cylindrical shape having truncated conical heads on opposite sides thereof, and held there via a supporting member not shown. The supporting member is made of material having the insulation property, the thermal stability, the shock-absorbing property or others, such as alumina mat.

Figure 2:
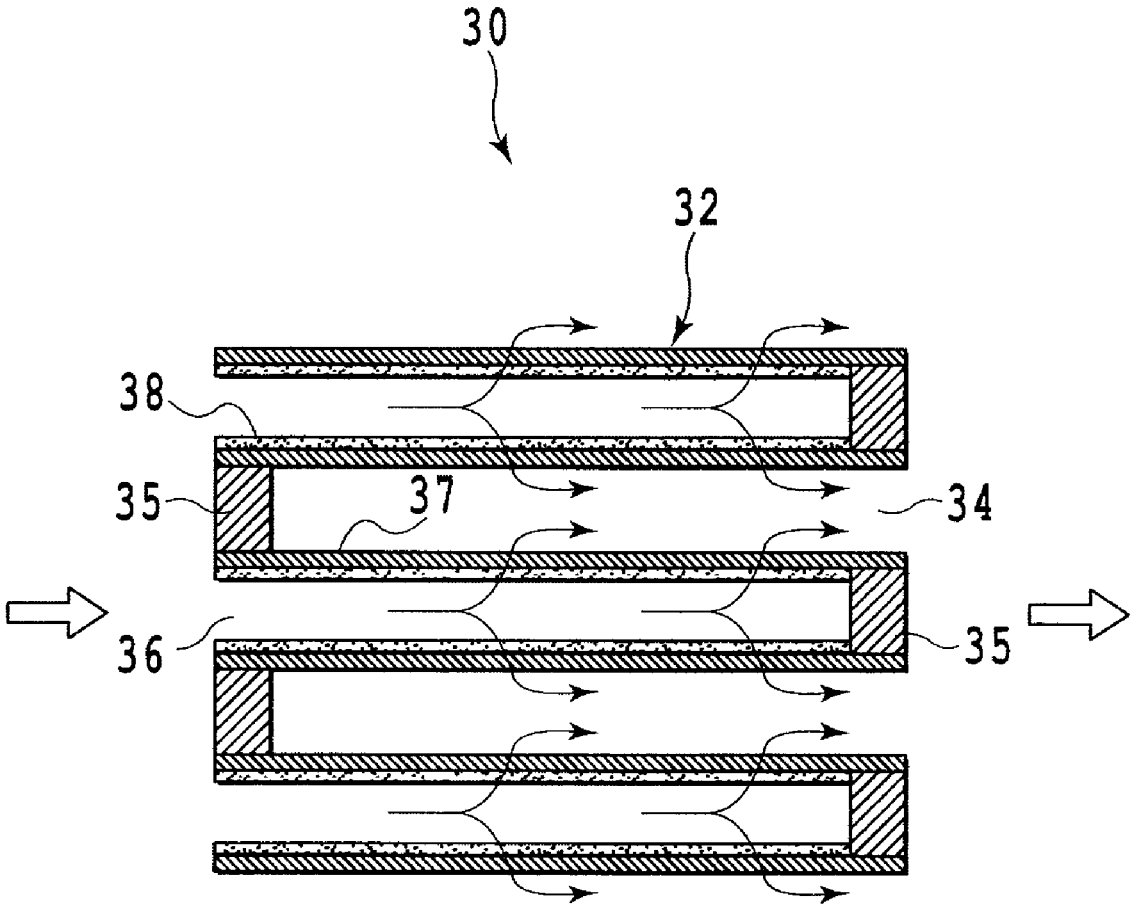
FIG. 2 is a cross-sectional view illustrating a wall-flow type honeycomb structure of DPF.

As shown in FIG. 2, DPF 30 is of a so-called wall flow type having a honeycomb structure 32 made of porous ceramics, and the honeycomb structure 32 is formed of ceramics material such as cordierite, silica or alumina. The exhaust gas flows from left to right in the drawing as indicated by arrows.

The honeycomb structure 32 has first passages 34, each closed at an upstream end with a plug 33 and second passages 36, each closed at a downstream end with a plug 35, both of which passages are alternately arranged in a honeycomb manner. These passages 34 and 36 are also referred to as cells and arranged in parallel to the flowing direction of the exhaust gas. If the exhaust gas flows from left to right in the drawing, the exhaust gas in the second passage 36 enters the first passage 34 through a ceramics wall surface 37 and flows downstream. At that time, PM in the exhaust gas is trapped by the porous ceramics and is prevented from being discharged into the atmosphere. Such a kind of a filter that the exhaust gas passes through the wall surface of the flow path while filtrating and trapping PM in the exhaust gas is called as a wall flow type filter.

DPF 30 in this embodiment is a so-called catalyzed DPF wherein a catalyst 38 formed of precious metal such as Pt is carried or coated on an inner wall surface of the second passage 36. Accordingly, DPF 30 is capable of not only trapping PM but also removing harmful components (such as CO, HC or NOx) in the exhaust gas by using this catalyst.

As the ozone generator 41, a type wherein ozone is generated while supplying air or oxygen as raw material into a discharge tube capable of being applied with a high voltage, and any other types may be usable. Here, different from Patent Document 4, air or oxygen used as the raw material is a gas taken-in from outside of the exhaust pipe 15, for example, a gas contained in the outer air, which is not a gas contained in the exhaust gas within the exhaust passage 15 as in Patent Document 4. In the ozone generator 14, the efficiency for generating ozone is higher when a low-temperature raw material is used than when a high-temperature raw material is used. Accordingly, it is possible to improve the ozone-generation efficiency when the ozone is generated by using a gas outside the exhaust passage 15 than in the case of Patent Document 4.

Although described in more detail later, the ozone supplying nozzle 40 is disposed at a position directly upstream from DPF 30 so that ozone injected therefrom is uselessly consumed by reacting with NOx or HC in the exhaust gas, and supplies ozone toward DPF 30. Also, the nozzle supplying nozzle 40 has a plurality of ozone supplying ports 43 arranged over a whole diameter of the upstream end surface of DPF 30. The ozone supplying nozzle 40 is inserted into the interior of the casing 31 of DPF 30, extends in the diametrical direction of the casing 31, and fixed there. In this regard, types of the ozone supplying nozzle 40 may be possible other than that described above. For example, in a case having only one ozone supplying port, a distance between the ozone supplying port and the upstream end surface of DPF is preferably prolonged so that ozone is prevailed uniformly all over the upstream end surface thereof.

In this embodiment, there is means for detecting a deposited amount or a degree of clogging of PM in DPF 30. That is, exhaust pressure sensors 51, 52 are provided in the exhaust passages 15 upstream and downstream from DPF 30, respectively, for detecting the exhaust pressure, and connected to ECU 100 used as control means. ECU 100 determines the deposited amount or the degree of clogging of PM in DPF 30 based on the difference dP between an upstream exhaust pressure Pu detected by the upstream exhaust pressure and a downstream exhaust pressure P1 detected by the downstream exhaust pressure P1.

While the deposited amount or the degree of clogging of PM is detected based on the difference between the upstream and downstream exhaust pressures of DPF in this embodiment, it may be detected by only one exhaust pressure sensor disposed upstream from DPF 30. Further, it is also possible to detect the degree of clogging by the integration with time of soot signals issued from a soot sensor disposed upstream from DPF. Similarly, it may be possible to estimate data of engine characteristic map stored in ECU and integrate the same with time.

In this embodiment, means for detecting the temperature of exhaust gas flowing into DPF 30 or the bed temperature of DPF is provided. According to this embodiment, a temperature sensor 53 is provided at a position directly upstream from DPF 30, for detecting the temperature of exhaust gas flowing into DPF 30, and the exhaust gas temperature at a position directly upstream from DPF 30 is calculated based on signals detected by this temperature sensor 53. A temperature detection part of the temperature sensor 53 (a tip end in a case of a thermocouple) is preferably positioned in the vicinity of a center of the upstream end surface of DPF 30. A temperature detection part of the temperature sensor may be embedded in the interior of the DPF 30 for detecting the bed temperature of the interior of DPF. The above-mentioned sensors 51, 52 and 53 are all attached to the casing 31.

In this embodiment, normal components for controlling the common rail type diesel engine 10 are provided. ECU 100 is provided with a microcomputer including CPU, ROM, RAM, A/D converter and input/output interface or others, for carrying out the arithmetic processing based on signals issued from various sensors including the above-mentioned sensors 51, 52 and 53 and controlling the operation of the fuel injection valve 14, the high pressure pump 17, the ozone generator or others.

In the sensors described above, there are included a crank angle sensor (not shown) for detecting a crank angle of the engine 10, an accelerator opening degree sensor for detecting the opening degree of an accelerator (indicated by a reference numeral 55), a pressure sensor (not shown) for detecting a common rail pressure, a water temperature sensor (not shown) or others. ECU 100 calculates an engine rotational speed based on pulses output from the crank angle sensor, and calculates a fuel injection amount based on the engine rotational speed and the opening degree of the accelerator detected by the accelerator opening degree sensor, while using a predetermined map or others. Thereby, the fuel injection valve 14 is controlled to inject this fuel injection amount at a predetermined timing.

ECU 100 also controls the supply of ozone. That is, when the ozone generator 41 is made ON by ECU 100, ozone generates in the ozone generator 41, reaches, via the ozone supplying passage 42, the ozone supplying nozzle 40, and is injected downstream therefrom to DPF 30. If the ozone generator 41 is made OFF by ECU 100, the supply of ozone is interrupted. Further, ECU 100 also controls an amount of electric power fed to the ozone generator 41 so that the amount of supplied ozone is controlled.

According to this embodiment, since ozone is supplied to DPF 30 from upstream, it is possible to oxidize or burn off PM deposited in DPF 30 by the supplied ozone and remove the same. Thereby, DPF 30 is regenerated and exhibits the original capacity again.

By the way, since ozone is directly supplied into the exhaust gas, there is a problem in that ozone is consumed by the reaction with other components, typically HC and NOx, in the exhaust gas than PM to lower the PM cleaning efficiency in DPF 30.

The description will be made, for example, on the consumption of ozone by the reaction with NOx as follows.

When ozone O3 reacts with NOx, particularly NO, in the exhaust gas, a reaction formula thereof is represented by the following equation:

$$NO+O3 \rightarrow NO2+O2 \quad (1)$$

NO2 generated by this reaction is further reacted with ozone O3 as follows:

$$NO2+O3 \rightarrow NO3+O2 \quad (2)$$

And, NO3 generated by this reaction is decomposed as follows:

$$2NO3 \rightarrow 2NO2+O2 \quad (3)$$

Here, in the equation (1), ozone O3 is consumed by the oxidation of NO, and in the equation (2), ozone O3 is consumed by the oxidation of NO2. And, in the equation (3), NO2 on the right side becomes NO2 on the left side of the equation (2), whereby ozone O3 is consumed by oxidizing NO2 on the left side of the equation (2).

In such a manner, NOx and ozone repeat the chain reactions. Accordingly, even if ozone is supplied at a position directly before DPF 30, ozone is consumed by the oxidation and decomposition of NOx, provided NOx is contained in exhaust gas at that position, resulting in the reduction of amount of ozone to be supplied to DPF 30. Since the electric power is necessary for generating ozone by the ozone generator 41, such a useless consumption of ozone causes the useless consumption of electric power as well as the deterioration of fuel consumption.

In this embodiment, means is provided for interrupting the fuel injection of the engine 10 during the supply of ozone. If the fuel injection of the engine 10 is interrupted as such during the execution of ozone supply, it is possible to avoid that the ozone-consuming components such as NOx or HC are contained in the exhaust gas of the engine 10. That is, the exhaust gas discharged from the engine 10 becomes substantially air, whereby all of the supplied ozone is usable for cleaning PM in DPF 30 to significantly improve the PM cleaning efficiency in DPF 30.

The DPF regeneration control in this embodiment including such a stop of fuel injection; i.e., fuel-cut, will be described below.

[First Aspect of DPF Regeneration Control]

Figure 3:
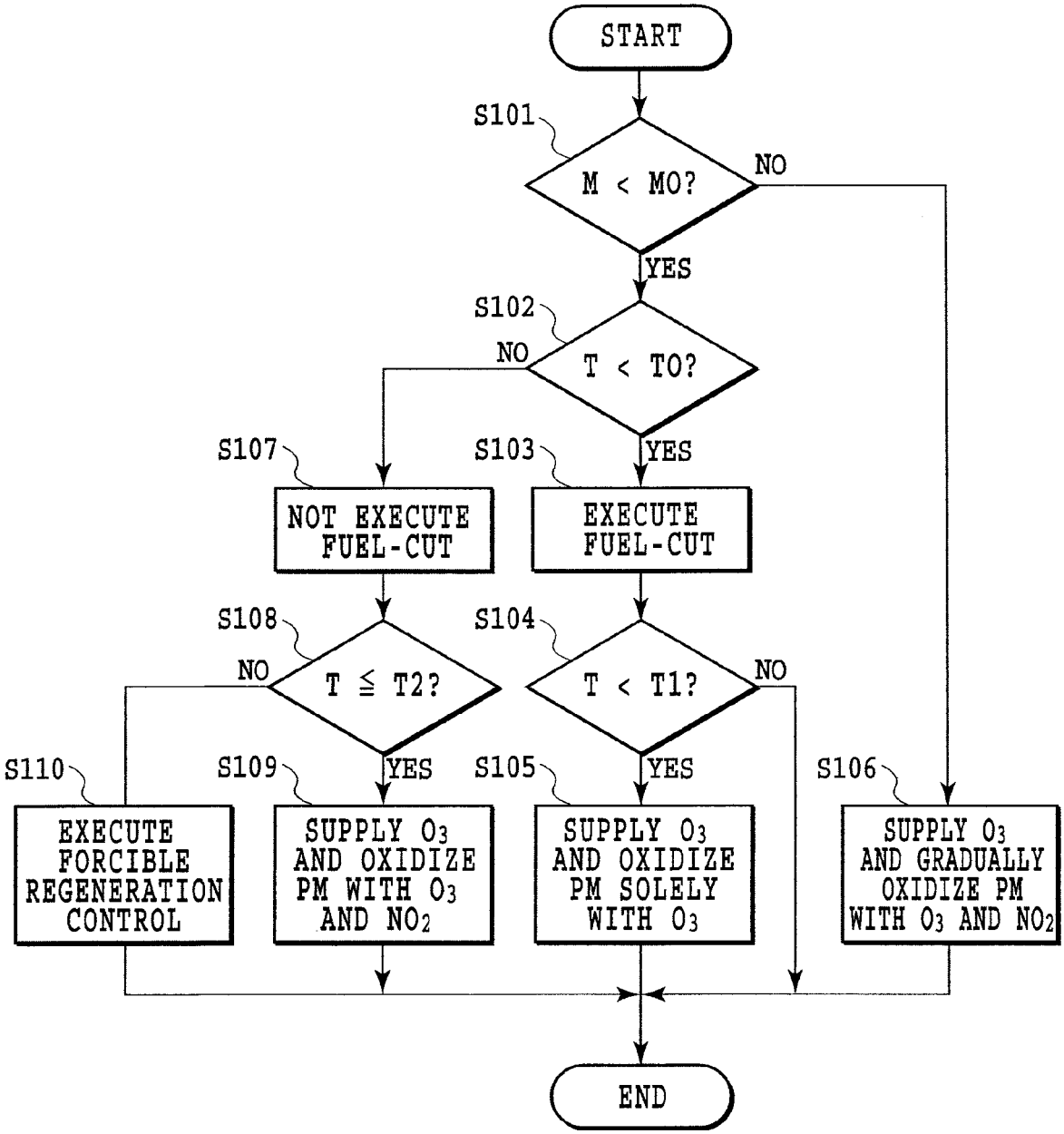
FIG. 3 is a flow chart of a first aspect of a regeneration control for DPF.

FIG. 3 indicates a first aspect of a control routine for the DPF regeneration control. This routine is repeatedly carried out at a predetermined period by ECU 100. In this regard, while three values T0, T1 and T2 are used for representing the temperature of the exhaust gas flowing into DPF 30 temperature in the routine, sizes of the three values are T1<T0<T2 in this aspect. Means of the respective values will be explained later. T1 is 250° C. and T2 is 450° C., for example.

The illustrated routine is carried out when the engine 10 is in an operating state capable of fuel-cutting, for example, when the engine 10 is decelerated and the accelerator opening degree is zero (fully closed), or when the accelerator becomes OFF to decelerate the vehicle in a case of an engine mounted on a vehicle. Whether or not such a state has been reached is determined by the ECU 100 based on the detected engine rotational speed and accelerator opening degree.

At the beginning of this routine, ECU 100 determines whether or not the amount of PM deposited in DPF 30 is smaller than an allowable deposited amount M0 of PM at a step S101. Here, the allowable deposited amount M0 of PM is a maximum value of PM amount capable of practically being deposited in DPF, in other words, an amount wherein if PM more than the allowable amount MO has been deposited, there may be a risk in that the deposited PM is oxidized and burnt at once to melt or break DPF.

The amount of PM deposited in DPF is correlative to the difference in pressure between the upstream side and the downstream side of DPF so that the more the amount of PM deposited in DPF, the larger the difference in pressure between the upstream side and the downstream side of DPF. Accordingly, in place of the amount of PM deposited in DPF, the difference in pressure between the upstream side and the downstream side of DPF is used for the determination. Concretely, ECU 100 calculates the difference in pressure between the upstream side pressure Pu detected by the upstream side exhaust pressure sensor 51 and the downstream side pressure Pl detected by the downstream side exhaust pressure sensor 52; that is, dP (Pu−Pl), and compares the same with a predetermined pressure difference threshold value dP0 corresponding to the above-mentioned allowable deposited amount M0 of PM. If the difference dP is smaller than the threshold value dP0, it is determined that the deposited amount M of PM is less than the allowable deposited amount M of PM, and the routine proceeds to a step S102. On the contrary, if the difference dP is equal to the threshold value dP0 or more, it is determined that the deposited amount M of PM is equal to the allowable deposited amount MO of PM or more, and the routine proceeds t a step S106.

At the step S106, the ozone generator 40 is made ON by ECU 100 to execute the supply of ozone. At that time, the fuel-cut is not executed. While ozone is uselessly consumed by the ozone-consuming components (NOx, HC) in the exhaust gas under such a circumstance that the amount of PM deposited in DPF is extremely large, the preference is given to the removal of deposited PM over the ozone-consumption efficiency. The supplied ozone is reacted with NOx in the exhaust gas to generate NO2 as described before. Since NO2 has a considerable oxidizing power not so large as ozone and is capable of oxidizing PM, PM deposited in DPF is gradually oxidized and removed by these ozone and NO2.

At a step S102, it is forecasted whether or not the temperature of DPF abnormally rises when the fuel-cut is executed. That is, when the fuel-cut is executed, a relatively large amount of air flows into DPF to instantly burn PM deposited in DPF, whereby the inconvenience, such as the crack or melting of DPF, may occur due to this air in a similar manner as described before. The abnormal temperature rise is liable to occur when the temperature of exhaust gas flowing into DPF becomes higher than a certain point, or in a case wherein the catalyzed DPF is used as in this embodiment in comparison with a case wherein a non-catalyzed DPF is used, or in a gasoline engine driven in the vicinity of a stoichiometric air/fuel ratio in comparison with the diesel engine.

At this step S102, the abnormal temperature rise of DPF described above is determined by using the temperature of the exhaust gas flowing into DPF. That is, ECU 100 compares the temperature T of the exhaust gas flowing into DPS detected by the temperature sensor 53 with a preliminarily stored predetermined value T0 (a second predetermined value called in the present invention). If the temperature T of the exhaust gas flowing into DPF is lower than the predetermined value T0, it is forecasted that the temperature of DPF does not abnormally rise even if the fuel-cut is executed, and the routine proceeds to a step S103 and the fuel-cut is executed. On the other hand, when the temperature T of the exhaust gas flowing into DPF is equal to the predetermined value T0 or higher, it is forecasted that the temperature of DPF abnormally rise if the fuel-cut is executed, and the routine proceeds to a step S107 at which the fuel-cut is not executed. As described above, the predetermined value T0 is a highest temperature at which the capability of DPF is guaranteed even though the fuel-cut is executed. In such a manner, it is possible to assuredly avoid the inconvenience such as the melting or crack of DPF as described before caused by the execution of the fuel-cut.

After the fuel-cut has been executed at the step S103, the routine proceeds to a step S104 at which ECU 100 compares the temperature T of the exhaust gas flowing into DPF with a preliminarily stored value T1 (a first predetermined value in the present invention) (wherein T1<T0). The value T1 is a highest temperature at which ozone is solely usable for the oxidation of PM, and which is generally an upper limit of a temperature range (temperature window) wherein ozone exists free from the thermal decomposition (for example, 250° C.). In this regard, the first predetermined value T1 is determined while taking a position of the temperature sensor 53, a position of DPF, an amount of gas flowing into DPF or others into consideration.

When the temperature T of the exhaust gas flowing into DPF is equal to the predetermined value T1 or higher, the routine is finished without executing the supply of ozone, in view of the effective application of ozone, because it could be thought that there is some amount of ozone disappeared due to the thermal decomposition even if it is supplied. On the other hand, when the temperature T of the exhaust gas flowing into DPF is lower than the predetermined value T1, the routine proceeds to a step S105 at which the ozone generator 41 is made ON to execute the supply of ozone whereby PM deposited in DPF is oxidized and removed solely by ozone, since it could be thought that the supplied ozone is effectively usable for the removal of the deposited PM while avoiding the thermal decomposition of the supplied ozone.

Here, even if T≧T1 (S104: NO) when the step S104 is initially executed, T<T1 (S104: YES) is satisfied soon while repeating the step S104, whereby it becomes possible to oxidize and remove PM solely by ozone. In other words, the control is carried out, for waiting until the exhaust gas temperature is lowered to a temperature at which the ozone does not disappear, whereby the effective application of ozone is also implemented here.

If it is determined that the fuel-cut is not executed at a step 107, the routine proceeds to a step S108. After the step S108, the removal of PM is selectively executed by using ozone (S109) or by the predetermined regeneration control (S110).

At the step S109, the supply of ozone is executed to generate nitrogen dioxide NO2 as the above-mentioned reaction formula, and oxidize and remove PM deposited in DPF thereby. In this regard, while there is a proper temperature window for the oxidation of PM with ozone (for example, T1=250° C. or lower), as mentioned before, a similar temperature window exists on nitrogen dioxide NO2, the highest temperature of which is T2=450° C., for example. In such a manner, nitrogen dioxide NO2 oxidizes PM in a temperature range higher than that of ozone.

While, at S110, in addition to the normal fuel injection, additional fuel is separately injected at a timing later than the former (for example, in an expansion stroke) to rise the temperature of DPF by the additionally injected fuel whereby PM deposited in DPF is oxidized and removed. In this regard, there are other methods; for example, a forcible regeneration control method wherein an amount of fuel more than usual is injected at a normal timing (for example, in the vicinity of a top dead center of the compression stroke), or a forcible regeneration control method wherein an injector for oxidizing PM is separately provided and fuel is injected therefrom.

At S108, ECU 100 compares the temperature T of the exhaust gas flowing into DPF with the preliminarily stored value T2. T2 is referred to as a third predetermined value for the sake of convenience. T1<T0<T2 is satisfactory. If the temperature T of the exhaust gas flowing into DPF is equal to the predetermined value T2 or lower, a process defined at S109 is executed, and if the temperature T of the exhaust gas flowing into DPF is higher than the predetermined value T2, a process defined at S110 is executed.

In the process at S109, since the fuel-cut is not executed, ozone is consumed by HC and NOx in the exhaust gas as well as the temperature T of the exhaust gas rises to a high temperature (T1<T0≦T≦T2) at which ozone is thermally decomposable, whereby all the supplied ozone could not be used for removing PM and the PM removal efficiency is not always favorable. Accordingly, the fuel consumption is not necessarily advantageous. On the other hand, in the process at S110, since the fuel for oxidizing PM is injected in addition to the usual fuel injection, the fuel consumption is of course disadvantageous.

At S108, the determination is made by comparing the both with each other, which method is advantageous in the fuel consumption. That is, at S108 to S110, either one of methods more advantageous in the fuel consumption is employed for the oxidation of PM in correspondence to the temperature T of the exhaust gas. So to speak, the predetermined value T2 is the highest temperature in a temperature range wherein the treatment by ozone executed at S109 is more favorable than the forcible regeneration control at S110 from the point of view of the fuel consumption. If the temperature T of the exhaust gas flowing into DPF is equal to the predetermined value T2 or lower, which temperature range is still as high as ozone may disappear, the ozone supply is executed, since it is relatively low temperature, to oxidize PM by ozone O3 and nitrogen dioxide NO2. Contrarily, since the disappearance of ozone is significant if the temperature T of the exhaust gas flowing into DPF exceeds the predetermined value T2, the supply of ozone is not executed but the oxidation of PM is carried out by the additional fuel injection.

Here, the relationship in size between the predetermined values T0 and T2 will be described below. These values represent temperatures higher than the highest temperature T1 in a range wherein ozone does not disappear. As described before, the temperature T0 is the highest temperature at which the capability of DPF is guaranteed even if the fuel-cut is executed, and the temperature T2 is the highest temperature at which the merit of fuel consumption becomes better in the forcibly regeneration control than in the ozone treatment.

In the control routine described here, the relationship of T0<T2 is kept. In such a case, the oxidation capability of the catalyst coated on DPF is relatively high to generate a large heat generation during the oxidation of PM. Accordingly, in this case, the abnormal temperature rise of DPF may relatively easily occur, whereby it is necessary for setting the temperature threshold value T0 for interrupting the fuel-cut at a relatively low temperature level.

However, there may be a case wherein no large heat generation occurs during the oxidation of PM in DPF, for example, since the oxidation capability of the catalyst coated on DPF is relatively low or DPF is not at all coated with the catalyst. In such a case, there may be a case wherein the predetermined value T0 is settable at a higher temperature whereby the relationship in size between the predetermined values T0 and T2 is reversed to be T2<T0. If so, it is possible not to execute the fuel-cut when the temperature of the exhaust gas becomes the predetermined value T0 set at a relatively high temperature, whereby the range wherein the fuel-cut could be executed is widened; that is, the upper limit for executing the fuel-cut becomes a higher temperature to widen a temperature range for effectively using ozone.

Now, a second aspect of the regeneration control of DPF usable when T2<T0 is satisfactory will be described below.

[Second Aspect of DPF Regeneration Control]

Figure 4:
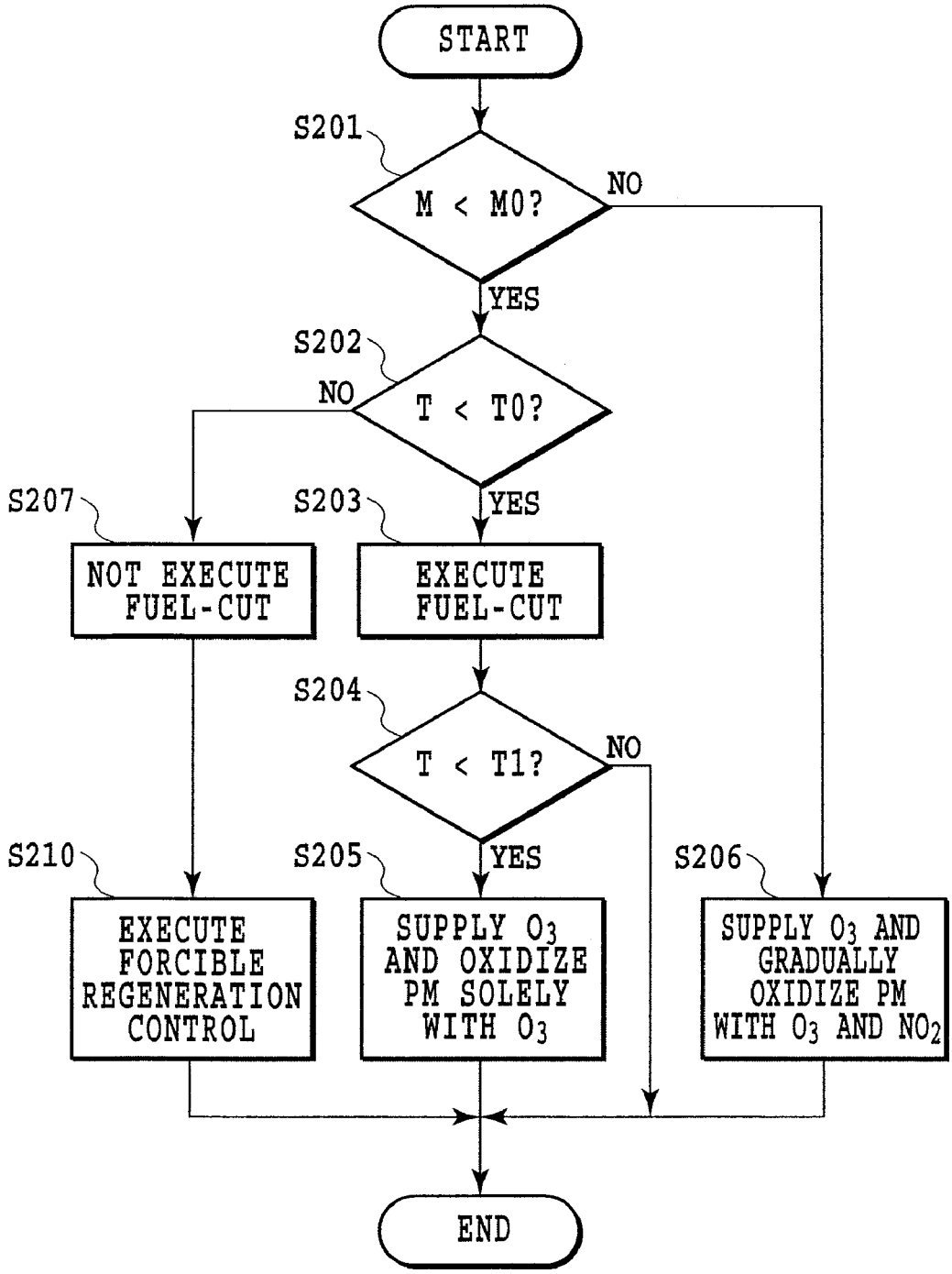
FIG. 4 is a flow chart of a second aspect of a regeneration control for DPF.

FIG. 4 illustrates a second aspect of a control routine for the regeneration control of DPF. This routine is also repeatedly executed by ECU 100 at a predetermined period. In this routine, the relationship in size of the predetermined values T0, T1 and T2 relating to the temperature of the exhaust gas flowing into DPF is T1<T2<T0 wherein sizes of the predetermined value T0 and T2 are reversed. In the same as before, T1 is, for example, 250° C. and T2 is, for example, 450° C. This routine is executed when the engine 10 is in the driving state capable of fuel-cutting.

Steps S201 to S207 are the same as the steps S101 to S107 in the first aspect. A difference between the both is that in the first aspect (see FIG. 3), the comparison of the temperature of the exhaust gas flowing into DPF with the predetermined value T2 at S108 is executed after the fuel-cut is not executed at S107, and based on the result thereof, either of the supply of ozone (S109) or the forcible regeneration control (S110) is executed, while in the second aspect, the fuel-cut is not executed at S207, and thereafter, the forcible regeneration control is executed at S210 in the same manner as at the above-mentioned S110.

As described before, since T2<T0 is satisfied in the second aspect, if the answer is negative (NO) at S202, T0≦T, namely, T2<T is satisfied. Accordingly, there is hardly a merit on the fuel consumption even though ozone is used, whereby the oxidation and removal of PM is executed by the forcible regeneration control without the supply of ozone.

The embodiment of the present invention has been described hereinabove, but the present invention can adopt other embodiments. For example, while the wall flow type DPF is adopted in the above-mentioned embodiment adopts, any other filter structures can be adopted. For example, a static straight flow type filter may be employed, wherein electric discharge is generated by applying a pair of electrodes with a DC voltage to charge PM to minus, for example, and attract the same to a plus side or an earth side electrode. Accordingly, the PM trapping device is formed as a plus or earth side electrode. Also, shapes or structures of substrates may be a honeycomb type as described before and other types including a plate type, a tube type, a pellet type or a mesh type.

While the ozone generator is switched ON to immediately supply the generated ozone when supplying the same in this embodiment, it is also possible to preliminarily generate and store ozone to supply it by switching a valve. Also, ozone may be compressed by a pump or a compressor prior to being supplied.

Also, an air/fuel ratio sensor may be provided, for example, at a position directly upstream of DPF so that when the air/fuel ratio sensor detects (or outputs) the air/fuel ratio corresponding to that at a time of the fuel-cut. Since there is a time lag until the influence of fuel-cut made on the combustion chamber side reaches DPF, it is possible to execute the ozone supply after the ozone-lost component has been assuredly discharged and to effectively use ozone. In this case, ECU 100 executes the supply of ozone at S105 (or S205) when the condition that "the detected air/fuel ratio corresponds to that upon the fuel-cut" (or "the air/fuel ratio sensor outputs a signal corresponding to the fuel-cut") is satisfied in addition to the condition of T<T1 at S104 (or S204).

While the control is executed based on the temperature of the exhaust gas flowing into DPF in the above-mentioned embodiment, it may be executed based on the bed temperature of DPF.

The present invention is applicable not only to a diesel engine as an internal combustion engine of a compressive ignition type but also to all kinds of internal combustion engines having the possibility of the generation of PM. For example, such an engine is a spark ignition type internal combustion engine, more concretely, a direct injection gasoline engine of a lean burn type. In this engine wherein fuel is directly injected into an in-tube combustion chamber, the fuel does not completely burn in a highly loaded area supplied with a large amount of fuel, whereby there is a possibility of the generation of PM. If the present invention is applied to such an engine, the favorable operation and effect are sufficiently expectable.

As apparent from the above description, according to this embodiment, part of ECU 100 executing S104 or S204 constitutes means for interrupting the fuel injection called in the present invention, part of ECU 100 executing S102 and S202 constitutes a forecasting means called in the present invention, and the temperature sensor 53 and ECU 100 constitute a temperature detection means called in the present invention.

Embodiments of the present invention should not be limited to those described above, but the present invention includes all modifications, variations or equivalents encompassed within a scope of the present invention defined by claims. Accordingly, the present invention should not be narrowly interpreted but is applicable to any other technique attributing to the scope of technical idea of the present invention.

INDUSTRIAL APPLICABILITY

The present invention is applicable to an internal combustion engine provided with particulate matter trapping device for trapping particulate matter in exhaust gas in an exhaust passage.

The invention claimed is:

1. A device for controlling an internal combustion engine, comprising:

a trapping device configured to trap particulate matter in exhaust gas in an exhaust passage;

an ozone supplying device configured to supply ozone to said trapping device from an upstream thereof;

an interrupting device configured to interrupt fuel injection of said internal combustion engine upon execution of ozone supply by said ozone supplying device; and a forecasting device configured to forecast whether or not a temperature of said trapping device abnormally rises when the fuel injection is interrupted by said interrupting device, wherein said interrupting device executes the interruption of the fuel injection when the abnormal temperature rise of said trapping device is not forecast by said forecasting device.

2. The device for controlling an internal combustion engine as defined by claim 1, further comprising a temperature detection device configured to detect a bed temperature of said trapping device or a temperature of exhaust gas flowing into said trapping device, wherein the supply of ozone is not executed until a temperature detected by said temperature detection device becomes lower than a first predetermined value after the interruption of the fuel injection by said interrupting device, and the supply of ozone is executed after the detected temperature becomes lower than the first predetermined value.

3. The device for controlling an internal combustion engine as defined by claim 1, wherein when it is forecasted by said forecasting device that the temperature of said trapping device abnormally rises, said interrupting device does not execute the interruption of fuel injection, but the supply of ozone or a predetermined forcible regeneration control is executed.

4. The device for controlling an internal combustion engine as defined by claim 1, further comprising a temperature detection device configured to detect a temperature of exhaust gas flowing into said trapping device or a bed temperature of said trapping device, wherein said forecasting device compares the temperature detected by said temperature detection device with a second predetermined value to determine whether or not the abnormal temperature rise occurs in said trapping device.

5. A method for controlling an internal combustion engine, comprising the steps of:

supplying ozone to a device for trapping particulate matter in an exhaust passage from the upstream of the device, and interrupting the fuel injection of said internal combustion engine during the execution of the ozone supply; and forecasting whether or not the temperature of said particulate matter trapping device abnormally rises when said fuel injection is interrupted, wherein if it is forecast by said forecasting step that the temperature of said particulate matter trapping device does not abnormally rise, said step for interrupting the fuel injection is executed.

6. The method for controlling an internal combustion engine as defined by claim 5, further comprising a step of detecting a temperature of exhaust gas flowing into said particulate matter trapping device or a bed temperature of said particulate matter trapping device, wherein said ozone supplying step is not executed until the temperature detected by said temperature detecting step becomes lower than the first predetermined value after interrupting the fuel injection in the interrupting step, but is executed after the detected temperature has become lower than the first predetermined value.

7. The method for controlling an internal combustion engine as defined by claim 5, wherein if it is forecast by said forecasting step that the temperature of said particulate matter trapping device abnormally rises, said fuel injection interrupting step is not executed but said ozone supply or a predetermined forcible regeneration control is executed.

8. The method for controlling an internal combustion engine as defined by claim 5, further comprising a step of detecting a temperature of exhaust gas flowing into said particulate matter trapping device or a bed temperature of said particulate matter trapping device, wherein at said forecasting step, the temperature detected at said temperature detecting step is compared with a second predetermined value to determine whether or not the abnormal temperature rise occurs in said particulate matter trapping device.

* * * * *